US007665316B2

(12) United States Patent
Ito et al.

(10) Patent No.: US 7,665,316 B2
(45) Date of Patent: Feb. 23, 2010

(54) AUTOMATIC ICEMAKER

(75) Inventors: Hideaki Ito, Kiryu (JP); Naotaka Sasaki, Kiryu (JP); Kenji Sugaya, Kiryu (JP)

(73) Assignee: Japan Servo Co., Ltd., Tokyo (JP)

( * ) Notice: Subject to any disclaimer, the term of this patent is extended or adjusted under 35 U.S.C. 154(b) by 505 days.

(21) Appl. No.: 11/432,522

(22) Filed: May 12, 2006

(65) Prior Publication Data

US 2007/0089441 A1 Apr. 26, 2007

(30) Foreign Application Priority Data

Oct. 25, 2005 (JP) ..... 2005-309386
Oct. 25, 2005 (JP) ..... 2005-309387

(51) Int. Cl.
*F25C 1/00* (2006.01)

(52) U.S. Cl. ..... 62/135; 62/353

(58) Field of Classification Search ..... 62/233, 62/208, 209, 137, 135, 340, 381, 347, 353; 222/146.6; 312/401, 405.1, 408, 404
See application file for complete search history.

(56) References Cited

U.S. PATENT DOCUMENTS 522,486 A * 7/1894 Phenice ..... 126/266
2,005,735 A * 6/1935 Field ..... 62/1
2,181,580 A * 11/1939 Fitzsimmons ..... 62/135
2,526,262 A * 10/1950 Munshower ..... 62/137
2,545,558 A * 3/1951 Russell et al. ..... 62/157
2,778,198 A * 1/1957 Heath ..... 62/137
2,869,060 A * 1/1959 Chace ..... 318/37
2,955,440 A * 10/1960 Erickson et al. ..... 62/301
3,048,023 A * 8/1962 Taylor ..... 62/135
3,055,185 A * 9/1962 Lundstrom ..... 62/138
3,252,293 A * 5/1966 Frei, Sr. ..... 62/135
3,677,030 A * 7/1972 Nicholas ..... 62/353
3,703,086 A * 11/1972 Nijo ..... 62/209
4,142,377 A * 3/1979 Fogt ..... 62/135
4,233,819 A * 11/1980 Stottmann ..... 62/349
4,526,014 A * 7/1985 Suyama et al. ..... 62/347
5,090,210 A * 2/1992 Katayanagi et al. ..... 62/135

(Continued)

FOREIGN PATENT DOCUMENTS

JP 10-78276 A 3/1998

(Continued)

*Primary Examiner*—Frantz F Jules
*Assistant Examiner*—Alexis K Cox
(74) *Attorney, Agent, or Firm*—Birch, Stewart, Kolasch & Birch, LLP

(57) ABSTRACT

Disclosed is an automatic icemaker has a rotatably supported ice making portion having first and second ice making trays arranged in a back-to-back manner, a motor for rotating the ice making portion, a first and a second temperature detecting sensors for detecting the temperature of the first and second ice making tray or the temperature of ice within a compartment of the first and second ice making tray, and a signal processor for controlling the motor to turn over the ice making portion after the temperature of the first or second ice making tray, or the temperature of ice within a compartment of the first or second ice making tray, looking upward, detected by the first temperature detecting sensor or the second temperature detecting sensor has become stabilized in the vicinity of 0° C.

10 Claims, 6 Drawing Sheets

U.S. PATENT DOCUMENTS

| | | | | |
|---|---|---|---|---|
| 6,062,036 | A * | 5/2000 | Hobelsberger | 62/347 |
| 7,204,092 | B2 * | 4/2007 | Azcarate et al. | 62/72 |
| 7,386,993 | B2 * | 6/2008 | Castrellon et al. | 62/353 |
| 2002/0029575 | A1 * | 3/2002 | Okamoto | 62/125 |
| 2003/0005713 | A1 * | 1/2003 | Holmes et al. | 62/187 |
| 2004/0012314 | A1 * | 1/2004 | Hay et al. | 312/405.1 |
| 2006/0112715 | A1 * | 6/2006 | Chung | 62/340 |
| 2007/0227164 | A1 * | 10/2007 | Ito et al. | 62/135 |
| 2008/0092582 | A1 * | 4/2008 | Doran | 62/381 |
| 2009/0145158 | A1 * | 6/2009 | Anselmino et al. | 62/344 |
| 2009/0145159 | A1 * | 6/2009 | Kim et al. | 62/353 |
| 2009/0165490 | A1 * | 7/2009 | Maruyama et al. | 62/340 |
| 2009/0173090 | A1 * | 7/2009 | Yamaguchi et al. | 62/137 |
| 2009/0178420 | A1 * | 7/2009 | Amonett et al. | 62/73 |
| 2009/0193824 | A1 * | 8/2009 | Heger et al. | 62/126 |

FOREIGN PATENT DOCUMENTS

| | | | |
|---|---|---|---|
| JP | 2000-346506 | A | 12/2000 |
| JP | 2003-343949 | A | 12/2003 |

* cited by examiner

AUTOMATIC ICEMAKER

BACKGROUND OF THE INVENTION

1. Field of the Invention

The present invention relates to an automatic icemaker for producing ice.

2. Description of the Related Art

In a conventional automatic icemaker, ice is produced in this way. With use of an ice making tray, supported for rotation and having a first and a second face, the first and the second faces having pluralities of first and second small compartments provided thereon, respectively, water is poured into the first compartments while the first face of the ice making tray is looking upward. After the water in the first compartments has been frozen, the ice making tray is turned over, so that the ice in the first compartments is discharged into an ice bin disposed under the ice making tray. Then, water is poured into the second compartments on the second face which is now looking upward, and after the water in the second compartments has been frozen, the ice making tray is turned over so that the ice in the second compartments are discharged into the ice bin disposed under the ice making tray. Ice is thus produced through repetition of similar operations.

However, while ice is being produced with the use, for example, of the first face of the ice making tray, the second face is not operating to produce ice. Thus, it has been unable to produce ice efficiently.

SUMMARY OF THE INVENTION

An object of the present invention is to provide an automatic icemaker capable of producing ice efficiently.

According to the present invention, there is provided an automatic icemaker which includes an ice making portion supported for rotation and having a first and a second icemaking trays arranged in a back-to-back manner, a motor for rotating the ice making portion, a first and a second temperature detecting sensor for detecting the temperature of the first and the second ice making tray or the temperature of ice within a compartment of the first and the second ice making tray, and a signal processor for controlling the motor to turn over the ice making portion after the temperature of the first or the second ice making tray, or the temperature of the ice within a compartment of the first or the second ice making tray, looking upward, detected by the first temperature detecting sensor or the second temperature detecting sensor has become stabilized in the vicinity of 0° C.

According to the aspect of the present automatic icemaker, it is made possible to produce ice with the use of one of the ice making trays while the other ice making tray is used for producing ice, and therefore ice can be produced efficiently. Further, when the temperature of an upward-looking ice making tray, or the temperature of the ice within a compartment of the upward-looking ice making tray, has become stabilized in the neighborhood of 0° C., the water at the surface of the opening of the compartment of the ice making tray and the water in contact with the ice making tray, upward-looking, is already frozen. Therefore, even if the icemaking portion in this state is turned over, the ice or water in the process of being frozen will never drop out of the compartments of the ice making tray.

DETAILED DESCRIPTION OF THE INVENTION

Figure 1:
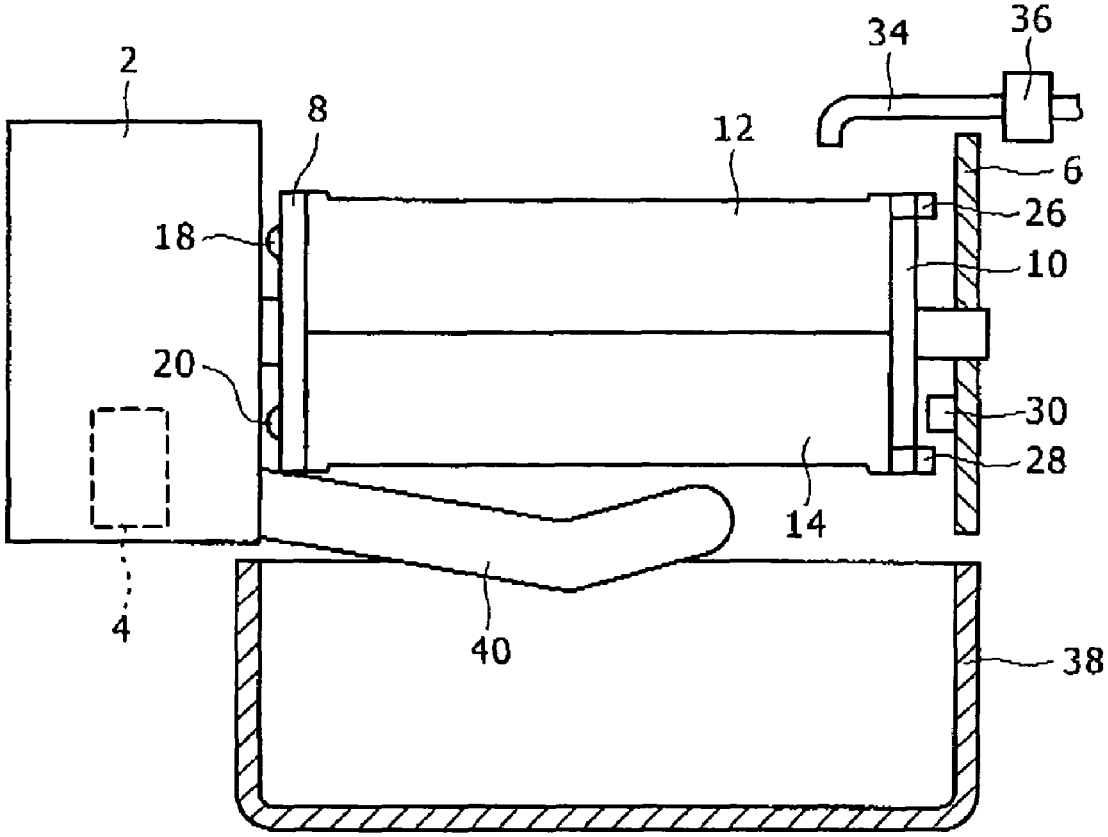
FIG. 1 is a schematic diagram showing an automatic icemaker of the present invention.
Figure 2:
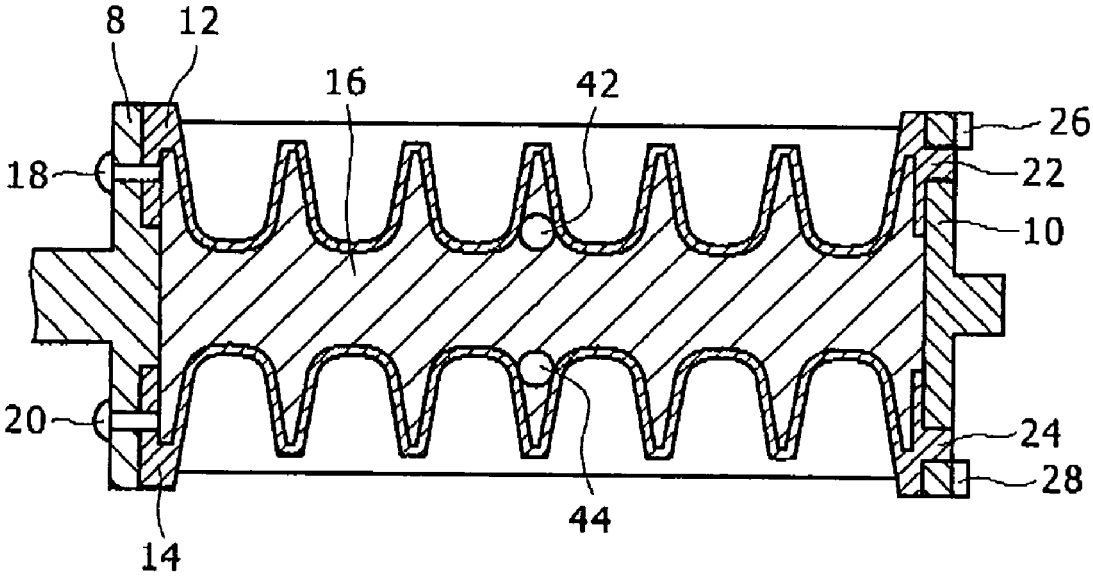
FIG. 2 is an enlarged sectional view showing an ice making portion of the automatic icemaker shown in FIG. 1.
Figure 3:
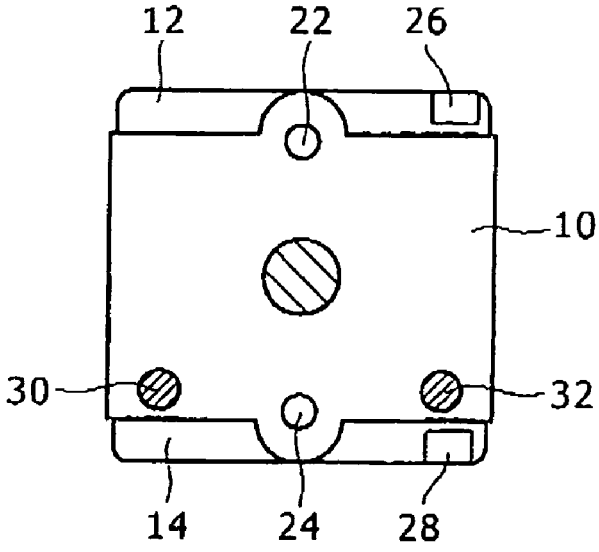
FIG. 3 is a side view of the ice making portion of the automatic icemaker shown in FIG. 2.
Figure 4:
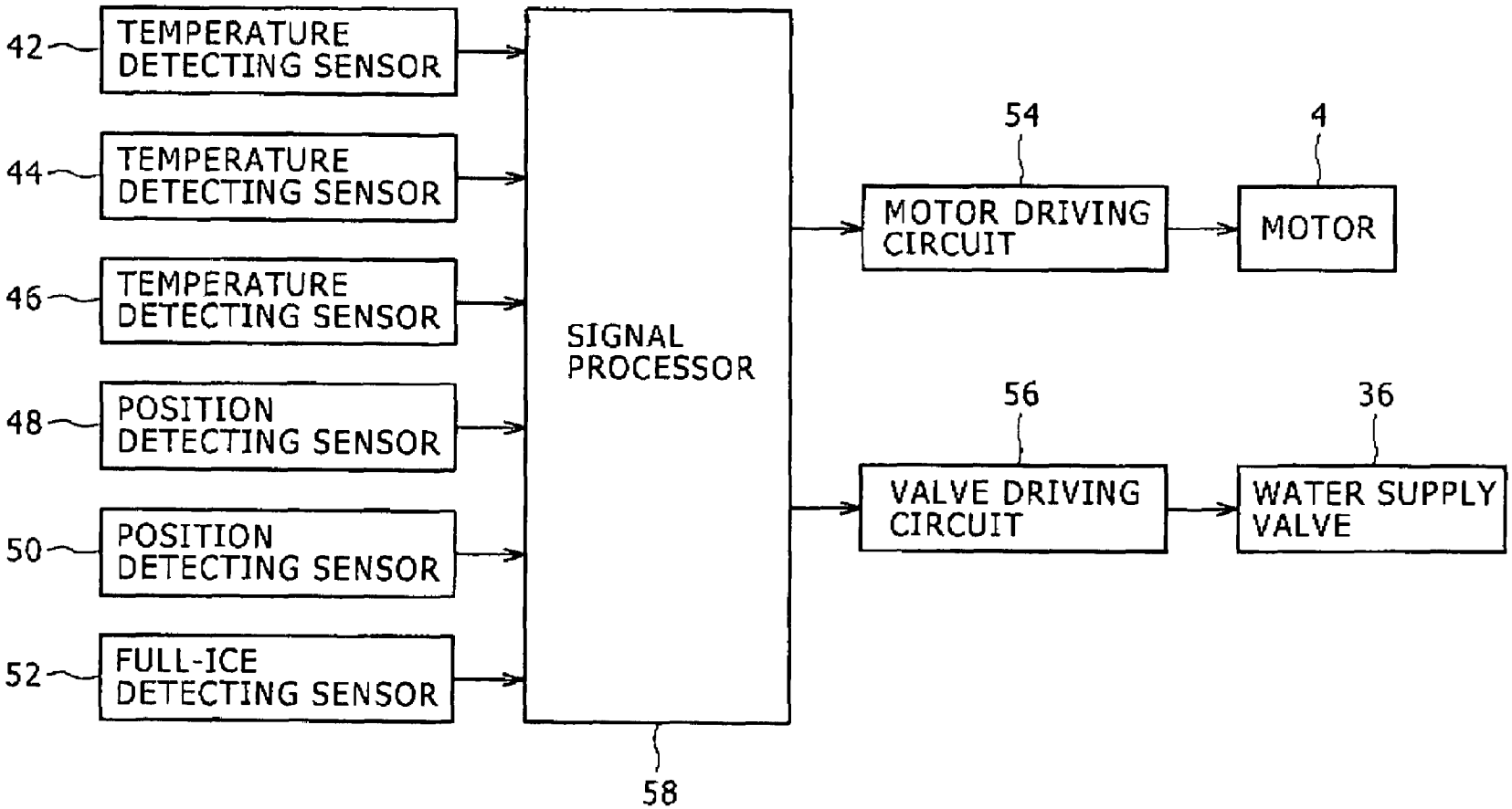
FIG. 4 is a system block diagram of the automatic icemaker shown in FIG. 1.

An automatic icemaker of the present invention will be described with reference to FIG. 1-FIG. 4. A motor 4 is installed in a control box 2. There is provided a frame 6 fixedly attached to the control box 2. A first side wall 8 is rotatably supported on the control box 2 and the side wall 8 is rotated by the motor 4. A second side wall 10 is rotatably supported on the frame 6. A first and a second ice making trays 12, 14 are each provided with a plurality of small compartments and top faces of partitions between the compartments are arranged to be lower in level than the top faces of the ice making trays 12, 14. There is interposed an elastic material 16, which is flexible and heat-insulative, between the ice making trays 12, 14 arranged in a back-to-back manner. One end faces of the ice making trays 12, 14 are fixed to the side wall 8 with screws 18, 20. On the other end faces of the ice making trays 12, 14, there are provided spindles 22, 24 and the spindle 22, 24 are inserted in holes made in the side wall 10. There are provided projections 26, 28 on the end faces of the ice making trays 12, 14 facing toward the frame 6. On the face of the frame 6 facing toward the ice making trays 12, 14, there are provided interceptors 30, 32. Thus, while an ice making portion is constructed of such components as the side walls 8, 10 and the ice making trays 12, 14, the ice making portion is rotated by the motor 4. Further, a configuration is formed of the spindles 22, 24, projections 26, 28, and the interceptors 30, 32 that causes each of the ice making trays 12, 14, looking downward, to be twisted independently of the other tray, by rotation of one end of the ice making portion by the motor 4.

Above the ice making portion, there is provided a water injector 34. The water injector 34 is provided with a water supply valve 36 having a feed water solenoid. Below the ice making portion, there is provided an ice bin 38. Above the ice bin 38, there is disposed a full-ice detecting arm 40, and the full-ice detecting arm 40 is driven by the motor 4.

There are provided a first and a second temperature detecting sensors 42, 44 for detecting the temperature of the ice making tray 12, 14. There is further provided a third temperature detecting sensor 46 for detecting the temperature inside the freezing chamber in which the automatic icemaker is installed. There is provided a position detecting sensor 48 for detecting that the ice making tray 12 is looking upward and held horizontal. There is also provided a position detecting sensor 50 for detecting that the ice making tray 14 is looking upward and held horizontal. A full-ice detecting sensor 52 is provided for detecting that the amount of ice within the ice bin 38 has reached a predetermined amount according to the movement of the full-ice detecting arm 40. There is provided a motor driving circuit 54 for driving the motor 4. There is provided a valve driving circuit 56 for driving the feed water solenoid of the water supply valve 36. There is provided a signal processor 58 accepting outputs of the temperature detecting sensors 42, 44, 46, the position detecting sensors 48, 50, and the full-ice detecting sensor 52 and A-D converting at least the outputs of the temperature detecting sensors 42, 44, 46 out of the outputs of the temperature detecting sensors 42, 44, 46, the position detecting sensors 48, 50, and the full-ice detecting sensor 52, thereby controlling the motor driving circuit 54 and the valve driving circuit 56. The signal processor 58 is constituted of an electronic circuit having an A-D converter, a microprocessor, and a counter and the signal processor 58 is installed in the control box 2.

Figure 5:
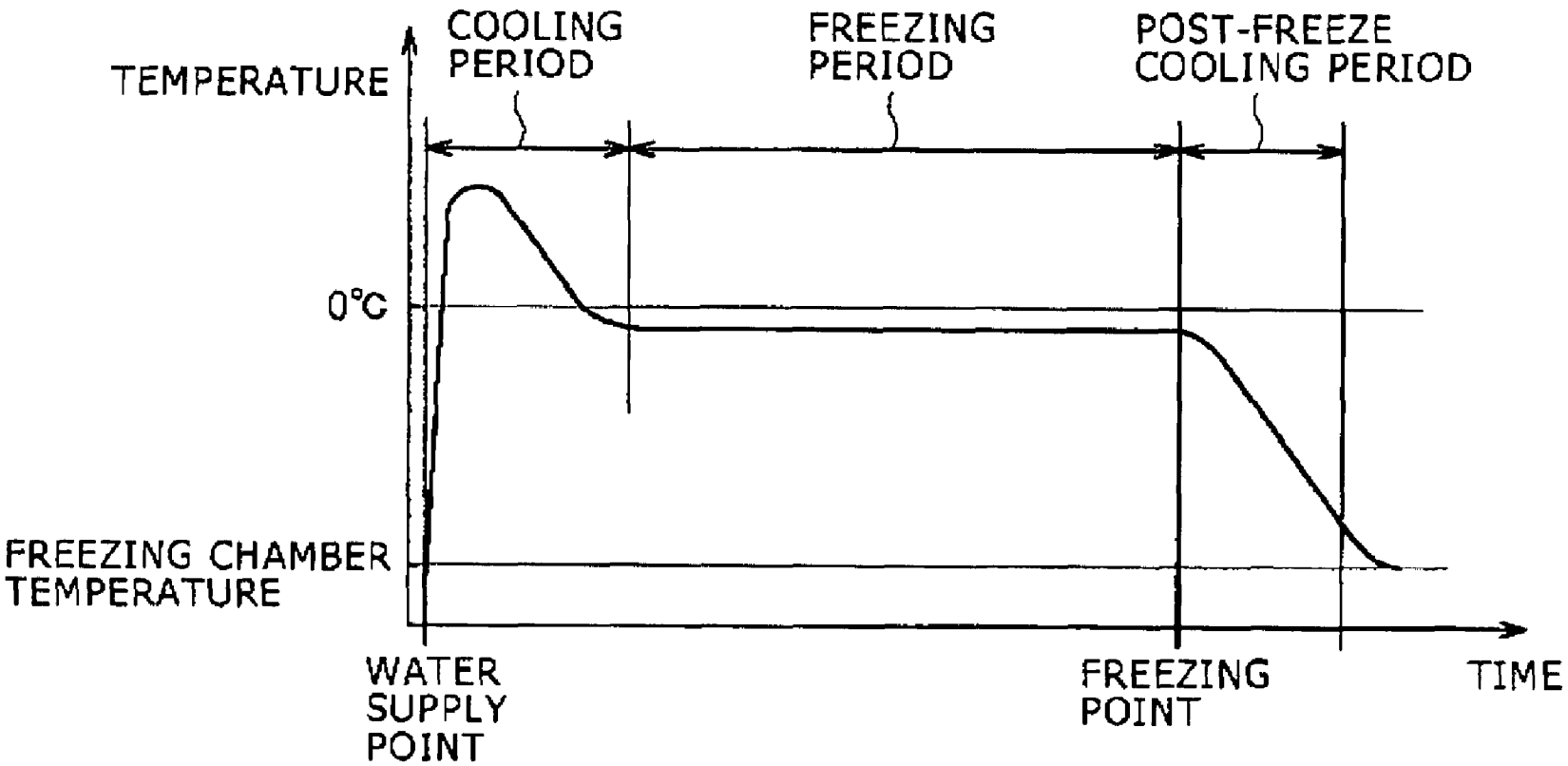
FIG. 5 is a graph showing temperature variations during the course of ice making performed by the automatic icemaker shown if FIG. 1-FIG. 4.

FIG. 5 is a graph showing variation in temperature of ice making tray 12 or 14 when ice is produced by the automatic icemaker shown in FIG. 1-FIG. 4. As apparent from the graph, when water is supplied to the compartments of the ice making tray 12 or 14, the temperature of the ice making tray 12 or 14 temporarily rises because the temperature of the supplied water is higher than the temperature of the ice making tray 12 or 14 that has been cooled by the cold air within the freezing chamber. Then, the temperature of the ice making tray 12 or 14 gradually falls (cooling period). When the temperature of the ice making tray 12 or 14 reaches a point below 0° C., the temperature of the ice making tray 12 or 14 remains kept at this point for a predetermined period of time (freezing period). When the predetermined period of time has passed, the temperature of the ice making tray 12 or 14 starts to fall again, and after the temperature of the ice making tray 12 or 14 has reached the temperature within the freezing chamber, the temperature of the ice making tray 12 or 14 remains unchanged at this point (post-freeze cooling period).

When the temperature of the upward-looking ice making tray 12 (14) detected by the temperature detecting sensor 42 (44) has been lowered to reach a point below 0° C. and the variation in temperature at this point has been kept smaller than a predetermined value for a predetermined period of time, then, a counter of the signal processor 58 starts its counting. When the counted value by the counter of the signal processor 58 has reached a predetermined value corresponding to the temperature within the freezing chamber detected by the temperature detecting sensor 46, the signal processor 58 controls the motor driving circuit 54, such that the motor 4 is driven by the motor driving circuit 54 to perform an ice isolating operation (to be discussed later) and, thereupon, turn over the ice making portion. In this way, the signal processor 58, when a period of time corresponding to the temperature within the freezing chamber has passed after the time the temperature of the ice within the compartment of the upward-looking ice making tray 12 (14) has become stabilized in the vicinity of the point below 0° C., controls the motor 4 so as to perform the ice isolating operation and, thereupon, to turn over the ice making portion.

With the present automatic icemaker installed in a freezing chamber, if an instruction to start ice making is issued while the ice making tray 12 is in its upward-looking state, the signal processor 58 controls the motor driving circuit 54 and the motor driving circuit 54 drives the motor 4, such that the motor 4 slightly rotates the ice making portion. In this state, the signal processor 58 controls the valve driving circuit 56 and the valve driving circuit 56. drives the feed water solenoid of the water supply valve 36 for a predetermined period of time, so that water is supplied from the water injector 34 into the compartments of the ice making tray 12 for a predetermined period of time. In this state, the water is allowed to flow along the top face of the ends of the partitions between the compartments so that the poured water is evenly supplied to each of the compartments. When the supply of water from the water injector 34 is ended, the signal processor 58 controls the motor driving circuit 54 and the motor driving circuit 54 drives the motor 4, such that the motor 4 rotates in a direction opposite to the direction in which it has rotated before until the position detecting sensor 48 detects that the ice making tray 12 is in its horizontal attitude, and thus the ice making tray 12 is brought into a horizontal position.

In this state, the water within the compartments of the ice making tray 12 starts to freeze. When a period of time corresponding to the temperature within the freezing chamber detected by the temperature detecting sensor 46 has passed after the time the temperature of the ice making tray 12 detected by the temperature detecting sensor 42 has reached a point below 0° C. and then has become stabilized, the signal processor 58 controls the motor driving circuit 54, such that the motor 4 is driven by the motor driving circuit 54 to rotate the ice making portion in the clockwise direction as viewed in FIG. 3 until it is detected by the position detecting sensor 50 that the ice making tray 14 has come to be in its horizontal position, whereby the ice making portion is turned over and the ice making tray 14 is brought into an upward-looking position.

Then, the signal processor 58 controls the motor driving circuit 54 and the motor driving circuit 54 drives the motor 4, such that the motor 4 slightly rotates the ice making portion. In this state, the signal processor 58 controls the valve driving circuit 56 and the valve driving circuit 56 drives the feed water solenoid of the water supply valve 36 for a predetermined period of time, so that water is supplied from the water injector 34 into the compartments of the ice making tray 14 for a predetermined period of time. In this state, the supplied water is allowed to flow along the top face of the ends of the partitions between the compartments so that the poured water is evenly supplied to each of the compartments. When the supply of water from the water injector 34 is ended, the signal processor 58 controls the motor driving circuit 54 and the motor driving circuit 54 drives the motor 4, such that the motor 4 rotates in a direction opposite to the direction in which it has rotated before until the position detecting sensor 50 detects that the ice making tray 14 is in its horizontal attitude.

Figure 6:
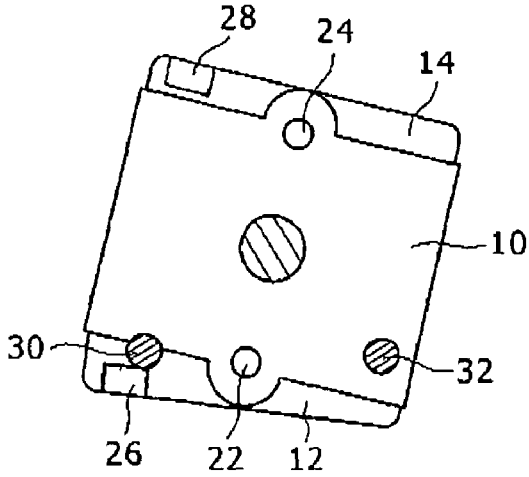
FIG. 6 and FIG. 7 are drawings explanatory of operation of the automatic icemaker shown in FIG. 1.

In this state, the water within the compartments of the ice making tray 14 starts to freeze. When a period of time corresponding to the temperature within the freezing chamber detected by the temperature detecting sensor 46 has passed after the time the temperature of the ice making tray 14 detected by the temperature detecting sensor 44 has reached a point below 0° C. and then has become stabilized, the signal processor 58 controls the motor driving circuit 54, such that the motor 4 is driven by the motor driving circuit 54 to make an ice isolating operation. Namely, as shown in FIG. 6, the motor 4 rotates the side wall 8 in the clockwise direction as viewed in FIG. 6. At this time, the end of the ice making tray 12 on the side toward the side wall 10 also rotates slightly in the clockwise direction as viewed in FIG. 6. However, since the projection 26 contacts with the interceptor 30, the end of the ice making tray 12 on the side toward the side wall 10 thereafter makes a rotation around the spindle 22 relatively with the side wall 10. As a result, the ice making tray 12 is twisted and therefore pieces of ice within the compartments of the ice making tray 12 fall into the ice bin 38. Thereafter, the motor 4 rotates the ice making portion in the counter-clockwise direction as viewed in FIG. 6 until the position detecting sensor 48 detects that the ice making tray 12 is brought into its horizontal position, whereby the ice making portion is turned over and the ice making tray 12 is brought into an upward-looking position.

Then, the signal processor 58 controls the motor driving circuit 54 and the motor driving circuit 54 drives the motor 4, such that the motor 4 slightly rotates the ice making portion. In this state, the signal processor 58 controls the valve driving circuit 56 and the valve driving circuit 56 drives the feed water solenoid of the water supply valve 36 for a predetermined period of time, so that water is supplied from the water injector 34 into the compartments of the ice making tray 12 for a predetermined period of time. In this state, the supplied water is allowed to flow along the top face of the ends of the partitions between the compartments go that the poured water is evenly supplied to each of the compartments. When the supply of water from the water injector 34 is ended, the signal processor 58 controls the motor driving circuit 54 and the motor driving circuit 54 drives the motor 4, such that the motor 4 rotates in a direction opposite to the direction in which it has rotated before until the position detecting sensor 48 detects that the ice making tray 12 is in its horizontal attitude.

Figure 7:
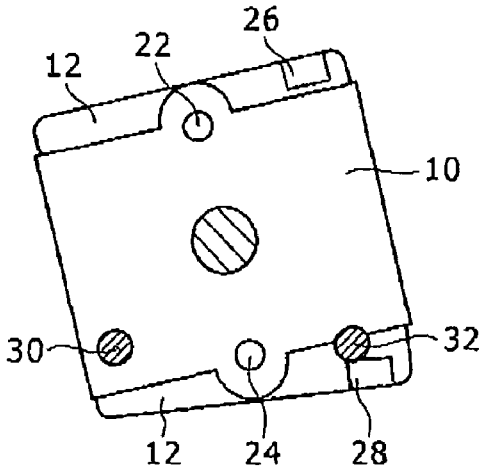

In this state, the water within the compartments of the ice making tray 12 starts to freeze. When the period of time corresponding to the temperature within the freezing chamber detected by the temperature detecting sensor 46 has passed after the time the temperature of the ice making tray 12 detected by the temperature detecting sensor 42 has reached a point below 0° C. and then has become stabilized, the signal processor 58 controls the motor driving circuit 54, such that the motor 4 is driven by the motor driving circuit 54 to make an ice isolating operation. Namely, as shown in FIG. 7, the motor 4 rotates the side wall 8 in the counterclockwise direction as viewed in FIG. 7. At this time, the end of the ice making tray 14 on the side toward the side wall 10 also rotates slightly in the counterclockwise direction as viewed in FIG. 7. However, since the projection 28 contacts with the interceptor 32, the end of the ice making tray 14 on the side toward the side wall 10 thereafter makes a rotation around the spindle 24 relatively with the side wall 10. As a result, the ice making tray 14 is twisted so that pieces of ice within the compartments of the ice making tray 14 fall into the ice bin 38. Then the motor 4 rotates the ice making portion in the clockwise direction as viewed in FIG. 7 until the position detecting sensor 50 detects that the ice making tray 14 is brought into its horizontal position, whereby the ice making portion is turned over and the ice making tray 14 is brought into an upward-looking position.

Through repetition of the above described operations, the produced ice is stored into the ice bin 38 and when the full-ice detecting sensor 52 detects that the amount of the ice in the ice bin 38 has reached a predetermined value, the signal processor 58 stops the ice making operation. After the user has taken out substantial amount of ice from the ice bin 38, if it is detected by the full-ice detecting arm 40 that the amount of ice within the ice bin 38 has become below a predetermined value, the signal processor 58 resumes the ice making operation.

During the sequence of ice making operations, the signal processor 58 monitors the temperatures of the ice making tray 12, 14, and the temperature within the freezing chamber. In the event that any of the temperatures of the ice making tray 12, 14, and the temperature within the freezing chamber takes a value deviated from a prescribed value due to such a fact that the door of the freezing chamber was open during the course of the ice making, it is judged as an abnormality and an abnormality recovering process prescribed for each production step at that time point is performed.

In the present automatic icemaker, it is made possible to make ice with the use of one ice making tray 12 (14) while ice is being produced with the use of the other ice making tray 14 (12). Therefore, ice can be produced efficiently. Further, when a period of time corresponding to the temperature within the freezing chamber detected by the temperature detecting sensor 46 has passed after the time the temperature of the upward-looking ice making tray 12 or 14 has reached a point below 0° C. and then has become stabilized, the water at the surface of the opening of the compartment of the ice making tray 12 or 14 and the water in contact with the ice making tray 12 or 14 is already frozen. Accordingly, even if the ice making portion is turned over in this state, it does not occur that ice or water in the process of being frozen would drop into the ice bin 38 from the ice making tray 12 or 14 that has just been turned downward. Further, during the ice making process, the downward-looking ice making tray 12 or 14 can be twisted independently of the other tray, and therefore the ice separating operation can be performed certainly.

Figure 8:
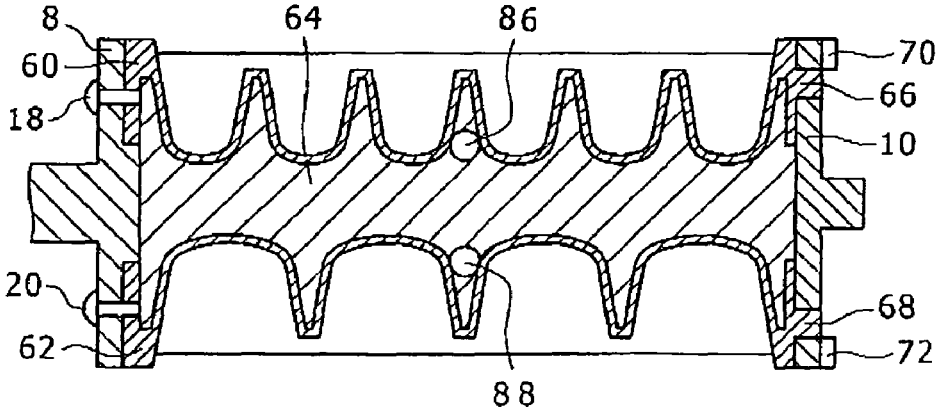
FIG. 8 is a sectional view showing an ice making portion of another example of the automatic icemaker of the present invention.

Referring now to FIG. 8, another example of the automatic icemaker of the present invention will be described. The ice making portion of the present automatic icemaker has a first and a second ice making tray 60, 62 arranged in a back-to-back manner, whereas the shape of compartments provided in the ice making tray 60 is different from the shape of compartments provided in the ice making tray 62. There is interposed an elastic material 64, which is flexible and heat-insulative, between the ice making trays 60, 62. End faces on one side of the ice making trays 60, 62 are fixed to the side wall 8 with screws 18, 20. On end faces on the other side of the ice making trays 60, 62, there are provided spindles 66, 68 and these spindles 66, 68 are inserted in holes made in the side wall 10. There are provided projections 70, 72 on the end faces of the ice making trays 60, 62 facing toward the side wall 10. There are provided temperature detecting sensors 86, 88 for detecting the temperature of the ice making tray 60, 62. Other parts of the structure are identical to those of the automatic icemaker shown in FIG. 1-FIG. 4. In this case, ice can be produced through similar operations to those in the automatic icemaker shown in FIG. 1-FIG. 4.

In the case of the present automatic icemaker, since the shape of the compartments provided in the ice making tray 60 is different from the shape of the compartments provided in the ice making tray 62, a plurality of shapes of ice can be produced.

Figure 9:
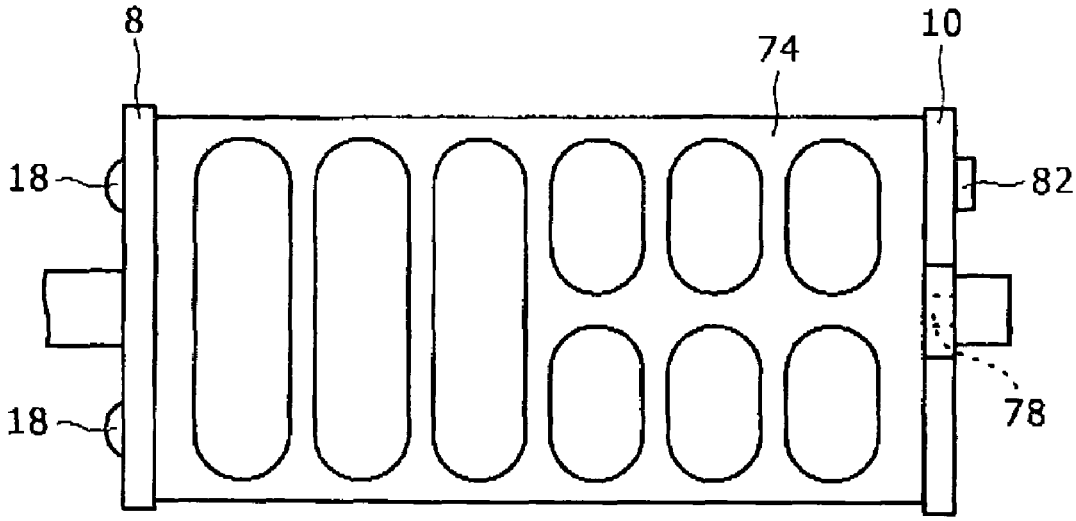
FIG. 9 and FIG. 10 are diagrams showing an ice making portion of a further example of the automatic icemaker of the present invention.
Figure 10:
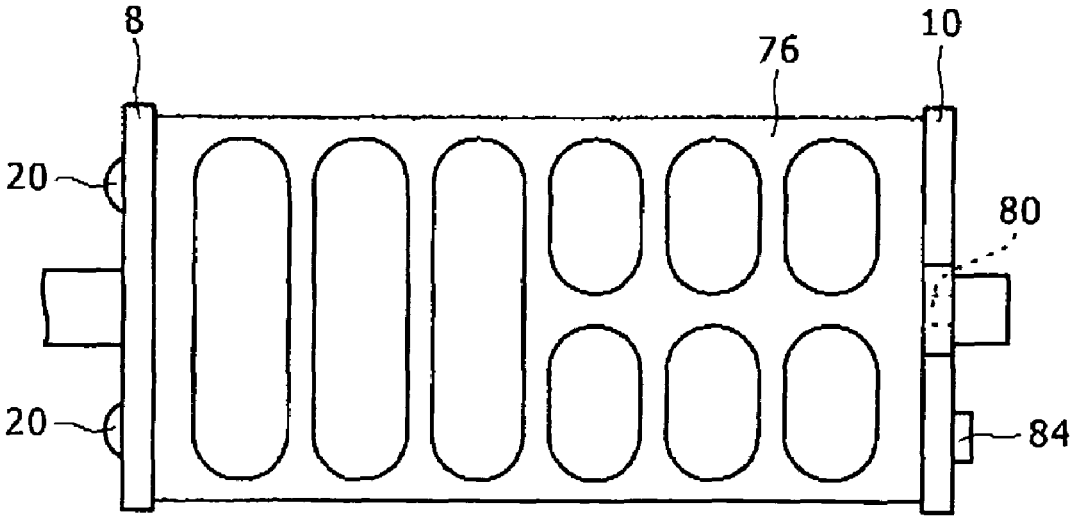

A further example of the automatic icemaker of the present invention will be described with reference to FIG. 9 and FIG. 10. The ice making portion of the present automatic icemaker has a first and a second ice making trays 74, 76 arranged in a back-to-back manner, whereas there are provided compartments of different sizes in the ice making tray 74, 76. End faces on one side of the ice making trays 74, 76 are fixed to the side wall 8 with screws 18, 20. On end faces on the other side of the ice making trays 74, 76, there are provided spindles 78, 80 and these spindles 78, 80 are inserted in holes made in the side wall 10. There are provided projections 82, 84 on the side faces of the ice making trays 74, 76 facing toward the side wall 10. Other parts of the structure are identical to those in the automatic icemaker shown in FIG. 1-FIG. 4. In this case, ice can be produced through similar operations to those in the automatic icemaker shown in FIG. 1-FIG. 4.

In the present automatic icemaker, since compartments of different sizes are provided in the ice making tray 74, 76, a plurality of shapes of ice can be produced.

Although, in the above described embodiments, there have been provided an elastic material 16 between the ice making trays 12, 14 and an elastic material 64 between the ice making trays 60, 62, the portion between the first and second ice making trays may be a vacant space. Further, in the above described embodiments, there are provided the temperature detecting sensors 42, 44 for detecting the temperature of the ice making tray 12, 14, or the temperature detecting sensors 86, 88, for detecting the temperature of the ice making tray 60, 62. However, there may be provided a first and a second temperature detecting sensors for detecting the temperature of ice within a compartment of the first and the second ice making tray. Further, in the above described embodiments, the ice separating operation has been performed when a period of time corresponding to the temperature within the freezing chamber detected by the temperature detecting sensor 46 has passed after the time the temperature of the ice making tray 12 or 14, looking upward, has become stabilized in the vicinity of 0° C. However, the ice separating operation may be performed when a predetermined period of time has passed after the time the temperature of the upward-looking ice making tray 12 or 14 has become stabilized in the vicinity of 0° C. Otherwise, the ice separating operation may be performed when the temperature of the upward-looking ice making tray 12 or 14 has reached a predetermined temperature corresponding to the temperature within the freezing chamber, that is, for example, a temperature a predetermined value higher than the temperature within the freezing chamber. Still otherwise, the ice separating operation may be performed when the temperature of the upward-looking ice making tray 12 or 14, after going through the freezing period, has started to be lowered again to enter into the post-freeze cooling period. Further, in the above described embodiments, water has been supplied into the compartments of the ice making tray 12 or 14 from the water injector 34 with the ice making portion slightly rotated by the motor 4, and thereafter the ice making tray 12 or 14 has been restored to its horizontal attitude. However, water may be supplied into the compartments of the ice making tray 12 or 14 with the ice making tray 12 or 14 maintained in its horizontal attitude. Further, in the above described embodiments, the ice separating operation has been performed by the rotation of the side wall 8, for example, in the clockwise direction as viewed in FIG. 6 caused by the motor 4 and, thereafter, the ice making portion has been turned over by the rotation of the ice making portion in the counterclockwise direction caused by the motor 4. However, the sequence of operations first giving a twist to the ice making tray 14 by having the side wall 8 rotated in the clockwise direction as viewed in FIG. 6 by the motor 4 and then releasing the twist by having the side wall 8 rotated in the counterclockwise direction as viewed in FIG. 6 by the motor 4 may be repeated a plurality of times, so that the ice separating operation may be performed and, thereafter, the ice making portion may be turned over by having the ice making portion rotated in the counterclockwise direction as viewed in FIG. 6 by the motor 4. Further, though the signal processor 58 constituted of an electronic circuit having an AD converter, a microprocessor, and a counter has been used in the above described embodiments, a signal processor constituted of an electronic circuit having a microprocessor incorporating an AD converter therein and a counter may be used. Further, though compartments different in shape have been provided in the ice making trays 74 and 76 in the above described embodiment, compartments different in shape may be provided in one of the first and the second ice making trays.

The foregoing invention has been described in terms of preferred embodiments. However, those skilled, in the art will recognize that many variations of such embodiments exist. Such variations are intended to be within the scope of the present invention and the appended claims.

What is claimed is:

1. An automatic icemaker comprising:

a) an ice making portion supported for rotation and having a first and a second ice making trays arranged in a back-to-back manner;

b) a motor for rotating said ice making portion; and c) a configuration in which each of said first and said second ice making trays, looking downward, can be twisted independently of the other tray by rotation of one end portion of said ice making portion by said motor.

2. The automatic icemaker according to claim 1, wherein said ice making portion has a first and a second side wall, said first side wall is supported for rotation, rotated by said motor, and has one end face of said first and said second ice making tray attached thereto, said second side wall is rotatably supported on a member and has holes made therein into which spindles formed on end faces of said first and said second ice making trays facing toward said second side wall are inserted, projections are provided on the end faces of said ice making trays facing toward said member, and said member supporting the second side wall thereon is provided with interceptors.

3. The automatic icemaker according to claim 1, wherein said ice making portion has one end thereof rotatably supported on a control box and another end thereof rotatably supported on a frame fixed to the control box and said motor is installed in said control box.

4. The automatic icemaker according to claim 1, wherein the compartments provided in said first ice making tray and the compartments provided in said second ice making tray are different in shape.

5. The automatic icemaker according to claim 1, wherein at least one of said first ice making tray and said second ice making tray is provided with compartments different in shape.

6. An automatic icemaker comprising:

an ice making portion supported for rotation and having a first and a second ice making trays arranged in a back-to-back manner;

a motor for rotating said ice making portion;

a first and a second temperature detecting sensors for detecting a temperature of said first and said second ice making tray or a temperature of ice within a compartment of said first and said second ice making tray;

a signal processor for controlling said motor to turn over said ice making portion after the temperature of said first or said second ice making tray that is facing upward, or the temperature of ice within a compartment of said first or said second ice making tray that is facing upward, that is detected by said first temperature detecting sensor or said second temperature detecting sensor, has become stabilized in a vicinity of 0° C.; and a configuration in which each of said first and said second ice making trays, looking downward, can be twisted independently of the other tray by rotation of one end portion of said ice making portion by said motor.

7. The automatic icemaker according to claim 6, wherein said ice making portion has a first and a second side wall, said first side wall is supported for rotation, rotated by said motor, and has one end face of said first and said second ice making tray attached thereto, said second side wall is rotatably supported on a member and has holes made therein into which spindles formed on end faces of said first and said second ice making trays facing toward said second side wall are inserted, projections are provided on the end faces of said ice making trays facing toward said member, and said member supporting the second side wall thereon is provided with interceptors.

8. The automatic icemaker according to claim 6, wherein said ice making portion has one end thereof rotatably supported on a control box and another end thereof rotatably supported on a frame fixed to the control box and said motor is installed in said control box.

9. The automatic icemaker according to claim 6, wherein the compartments provided in said first ice making tray and the compartments provided in said second ice making tray are different in shape.

10. The automatic icemaker according to claim 6, wherein at least one of said first ice making tray and said second ice making tray is provided with compartments different in shape.

* * * * *